United States Patent [19]

Westbrooks

[11] Patent Number: 4,469,359

[45] Date of Patent: Sep. 4, 1984

[54] DOOR LOCK ASSEMBLY

[76] Inventor: Larry Westbrooks, 1022 Lois Pl., Apartment 218, Joliet, Ill. 60435

[21] Appl. No.: 453,037

[22] Filed: Dec. 27, 1982

[51] Int. Cl.[3] ..... E05C 17/54; E05C 17/12

[52] U.S. Cl. ..... 292/288; 292/DIG. 15

[58] Field of Search ..... 70/94; 292/262, 288, 292/338, 339, 305, DIG. 15, DIG. 46

[56] References Cited

U.S. PATENT DOCUMENTS

| | | | |
|---|---|---|---|
| 132,922 | 11/1872 | Pharo | 292/339 |
| 1,082,432 | 12/1913 | Mertsheimer | 292/DIG. 15 X |
| 1,274,181 | 7/1918 | Meyers | 292/338 X |
| 1,392,467 | 10/1921 | Topp | 292/339 |
| 3,993,336 | 11/1976 | Frost | 292/DIG. 46 X |

FOREIGN PATENT DOCUMENTS

| | | | |
|---|---|---|---|
| 630304 | 8/1927 | France | 292/338 |

*Primary Examiner*—Richard E. Moore
*Attorney, Agent, or Firm*—Ernest Kettelson

[57] ABSTRACT

A door lock assembly comprising an anchor plate or other anchor means on the floor of a building spaced apart from a door with which the door lock assembly is to be used and in the direction which the door opens, and an elongated locking bar one end of which engages and is secured by the anchor plate or other anchor means, the other end of which abuts against the bottom edge of the door when in closed position to prevent it from being opened until the locking bar is removed from such position. The locking bar lies on the floor between the anchor means and the bottom edge of the closed door which makes it more difficult to dislodge by anyone trying to break in. The door may include a socket to receive the abutting end of the locking bar to keep it even more securely in place.

2 Claims, 8 Drawing Figures

DOOR LOCK ASSEMBLY

BACKGROUND OF THE INVENTION

This invention relates to the field of door locks and security devices to prevent entry into a building or apartment by unauthorized persons.

Door locks known to the prior art include lock mechanisms which hold the door latch itself from movement to the unlatching position, sliding bolt locks which are mounted on the door, usually in a horizontal position, and slide to a locking position wherein the projecting end of the bolt lock seats in a recess mounted in the door jamb or the wall adjacent to the edge of the door when closed; also chain locks mounted on the door having a latching end which is received in a latching recess mounted on the door jamb or the wall adjacent to the edge of the door when closed. There are also numerous variations of door locks of these various kinds which are known to the prior art.

Such locks known to the prior art have the disadvantage that they are no stronger than their connections are to the respective door and door jamb or wall, or than the door and jamb are themselves. A long enough pry bar can provide enough leverage to break the screws loose which hold the lock recess or lock seat to the door jamb or door wall. Also, there is a crack between the edge of the door to which the lock bolt or hook is mounted and the door jamb or wall on which the corresponding lock seat or lock recess is mounted whereby various tools and devices can be inserted or forced through such crack to break or open the lock.

The door lock in accordance with the present invention overcomes such problems and disadvantages of the door locks known to the prior art. The anchor plate or anchor means is bolted or otherwise secured to the floor, or formed in the floor, to provide an anchor for one end of the locking bar which is more secure and more difficult to break loose than the door itself or the door jamb or edge of the wall adjacent the door opening. The locking bar of this invention is positioned longitudinally, or in line, with the direction in which the door opens rather than laterally as in prior art door locks. A locking bar placed longitudinally or in-line with the direction of opening, rather than laterally across such direction, is much more difficult to force open or break, if not impossible, from the opposite side of the door. The end of the locking bar which abuts against the bottom edge of the door near its unhinged side provides the most positive and most secure locking engagement possible, with no mounting screws to force out, and virtually no way to break or bend a locking bar in such position.

SUMMARY OF THE INVENTION

It is an object of the invention to provide a door lock assembly comprising an elongated locking bar for a door, extending in the direction of opening of the door between such door and a spaced apart anchor means secured in or to the floor, the locking bar having one end received against the door near its unhinged edge when in place in locking engagement and the other end received against and held by said anchor means.

It is an object of the invention to provide a door lock assembly in which the locking bar extends longitudinally of the direction of door opening when in the locked position rather than laterally of such direction.

It is an object of the invention to provide a door lock assembly which is stronger than the door and its hinged mounting themselves whereby it would be easier to break the door and dislodge the hinges than it would to break the door lock from the opposite side of the door.

DESCRIPTION OF PREFERRED EMBODIMENT

Figure 1:
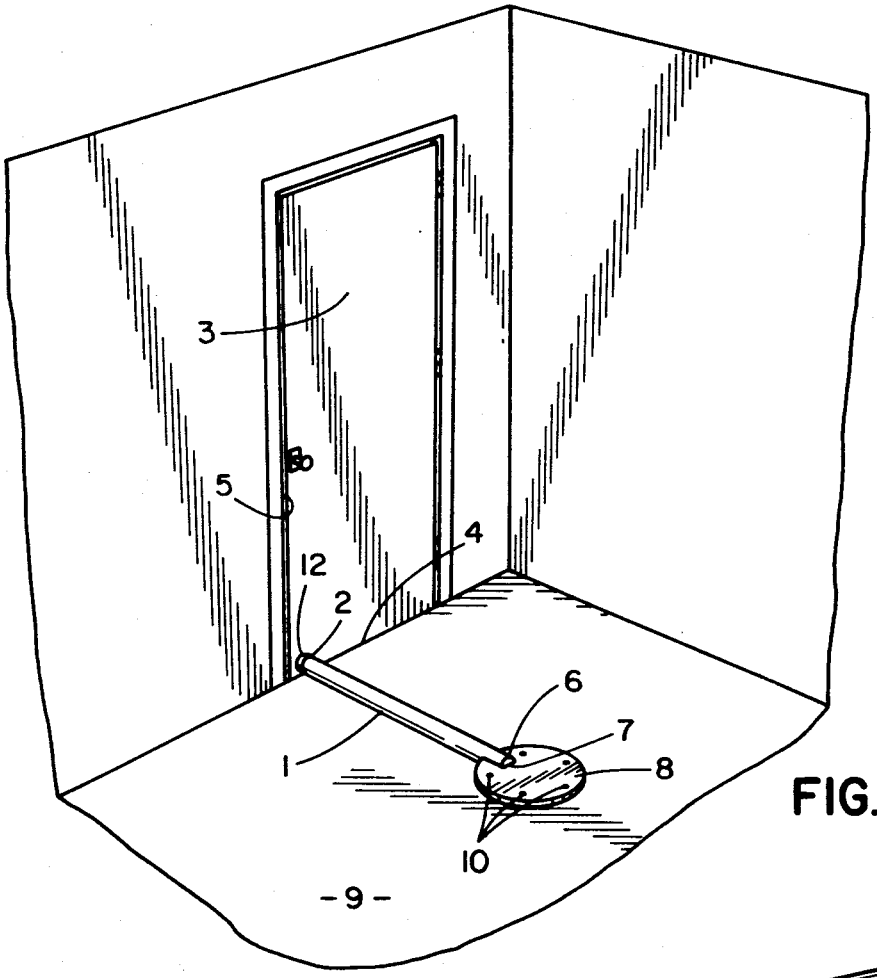
FIG. 1 is a perspective view showing a door in closed position and a door lock assembly in accordance with this invention in the locking position.
Figure 2:
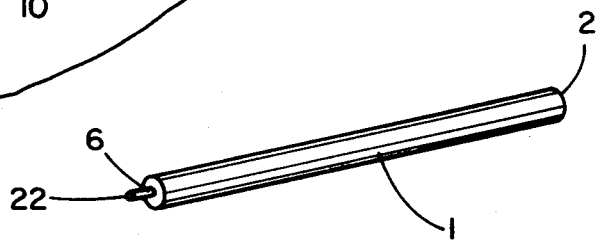
FIG. 2 is a perspective view of an elongated locking bar in accordance with this invention.

A door lock assembly in accordance with this invention includes an elongated locking bar 1, having a first end 2 which in its locking position abuts against the door 3 at its bottom edge 4 near its unhinged side edge 5. A second end 6 of the locking bar 1 is received in a slot 7 of an anchor plate 8 which is secured to the floor 9 by a plurality of bolts or screws 10.

The locking bar 1 and anchor plate 8 are placed on the side of the door 3 in the direction toward which the door opens. The anchor plate 8 is spaced apart rearwardly of the door 3 in such direction of opening a sufficient distance so the unhinged side edge 5 of the door 3 will clear the anchor plate 8 when it swings open.

The elongated locking bar 1 has a length equal to the distance between the bottom edge 4 of the door 3 and the abutting edge 11 of the anchor slot 7 of the anchor plate 8 when the door 3 is in its closed position. When the door 3 is closed, the locking bar 1 is laid on the floor 9 with its first end 2 abutting against the bottom edge 4 of the door 3 and its second end 6 received in the anchor slot 7 of anchor plate 8, the second end 6 of the locking bar 1 abutting against the abutting edge 11 of the anchor slot 7. The door lock assembly in accordance with this invention is then in locking position, and it becomes extremely difficult if not impossible for someone to break such lock from the opposite side of the door.

A socket 12 may be provided adjacent the bottom edge 4 of the door 3 in which the first end 2 of the locking bar 1 may be seated when in locking position, for even greater security. However, even without the socket 12 in the door 3, it would still be extremely difficult to dislodge the locking bar 1 from its position against the bottom edge of the door 3 since the anchor slot 7 is sufficiently elongated and close fitting to hold the locking bar 1 in its in-line position against the door 3. The anchor slot 7 includes side edges 13 and 14 which have relatively broad side walls 15 to provide a relatively wide bearing surface, they are relatively long to provide a relatively long bearing surface, and they are spaced apart a distance corresponding to the width of the locking bar 1 so it fits snugly within the slot 7 when received therein.

Figure 3:
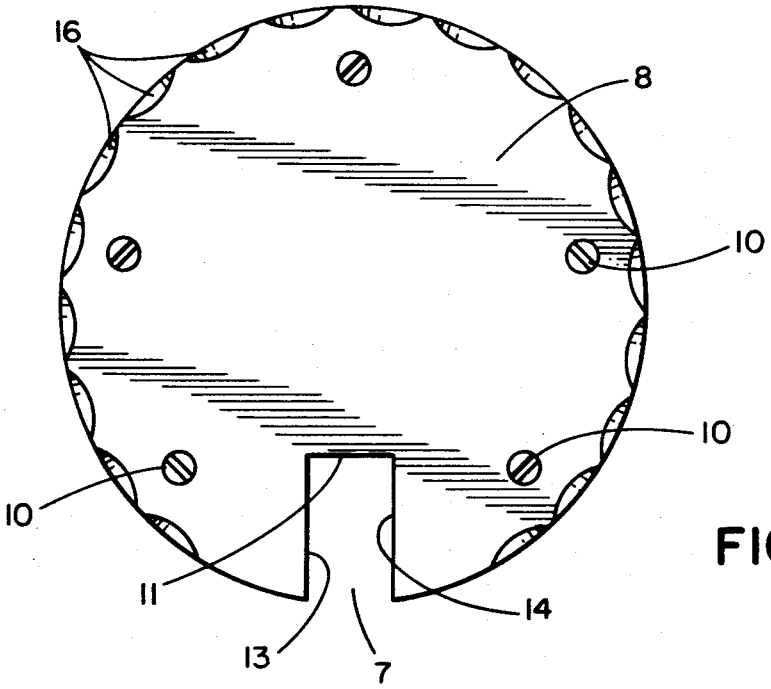
FIG. 3 is a plan view of a circular anchor plate for use in accordance with this invention.
Figure 4:
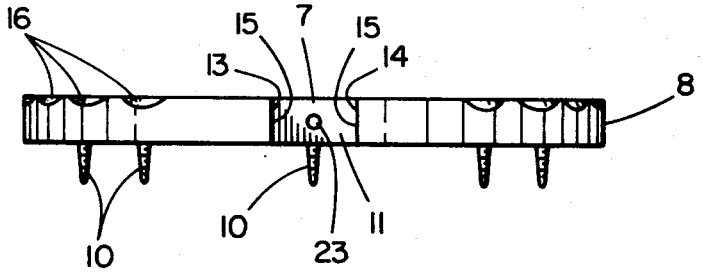
FIG. 4 is a side elevation view of the circular anchor plate of FIG. 3.
Figure 5:
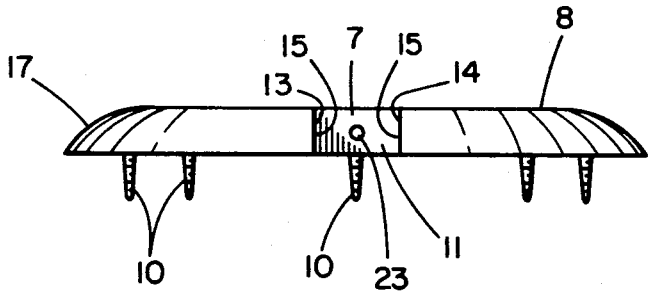
FIG. 5 is a side elevation view of a circular anchor plate similar to the one shown in FIGS. 3 and 4 but having a tapered peripheral edge.
Figure 6:
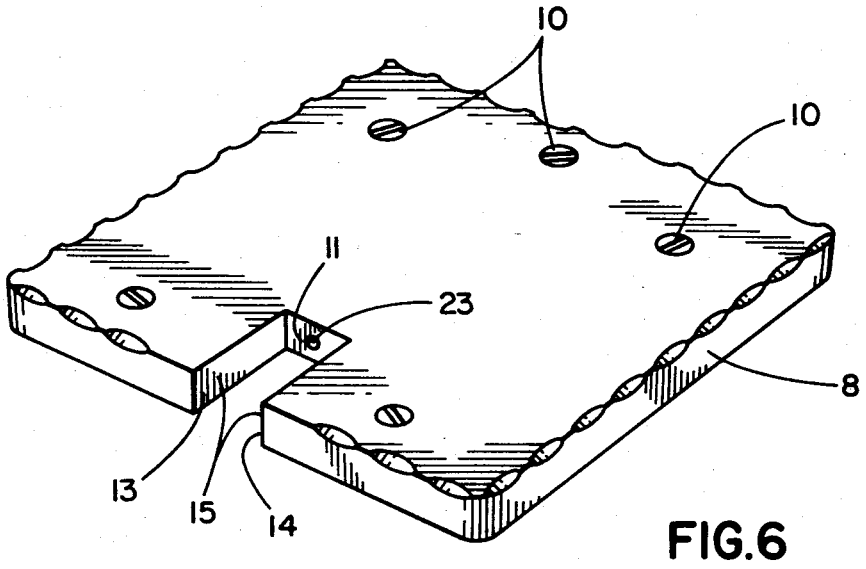
FIG. 6 is a perspective view of a rectangular anchor plate for use in accordance with this invention.

The anchor plate 8 may be circular in its peripheral configuration, rectangular or other geometric shape. It may have scalloped edges 16 for decorative purposes as shown in FIG. 3. It may have a tapered peripheral edge 17 as shown in FIG. 5. The locking bar 1 may be cylindrical in cross-section or it may be rectangular or other shape in cross-section. The locking bar and anchor plate 8 may be made of wood, or they may also be made of metal and other materials which have sufficient strength to function as locking devices.

Figure 7:
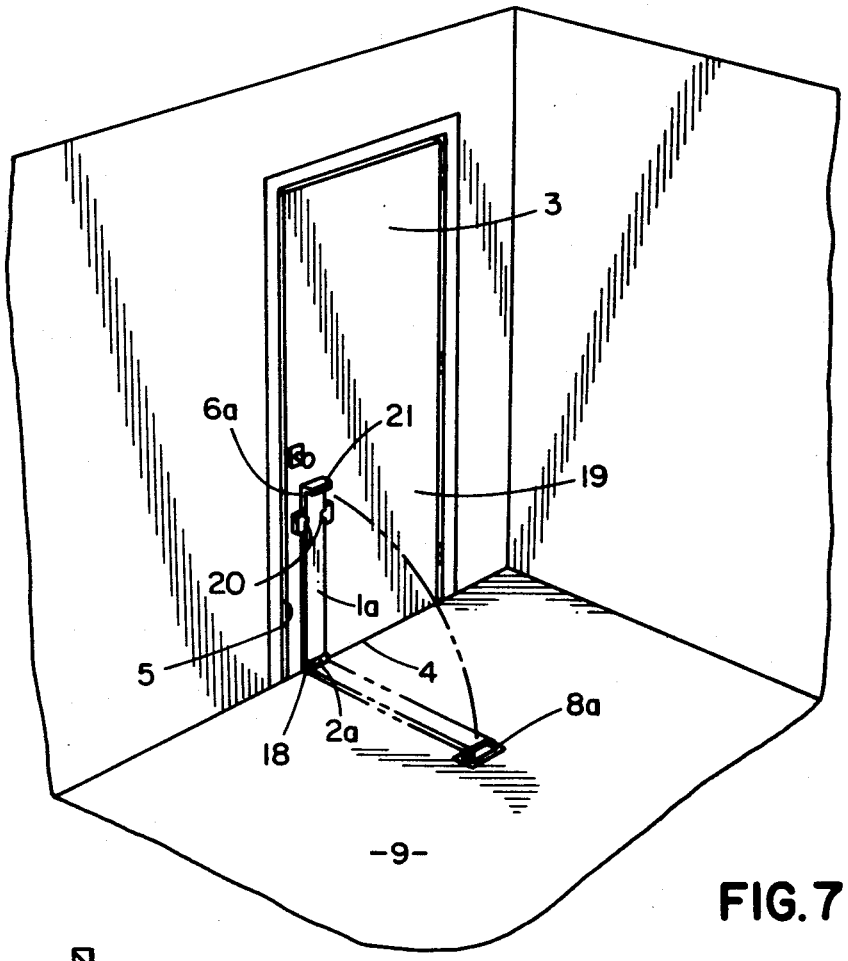
FIG. 7 is a perspective view showing a modification of this invention wherein the locking bar is hinged to the bottom edge of a door and shown in its unlocked position folded against the inside wall of the door, with broken lines showing how it would be pivoted to its locking position along the floor.
Figure 8:
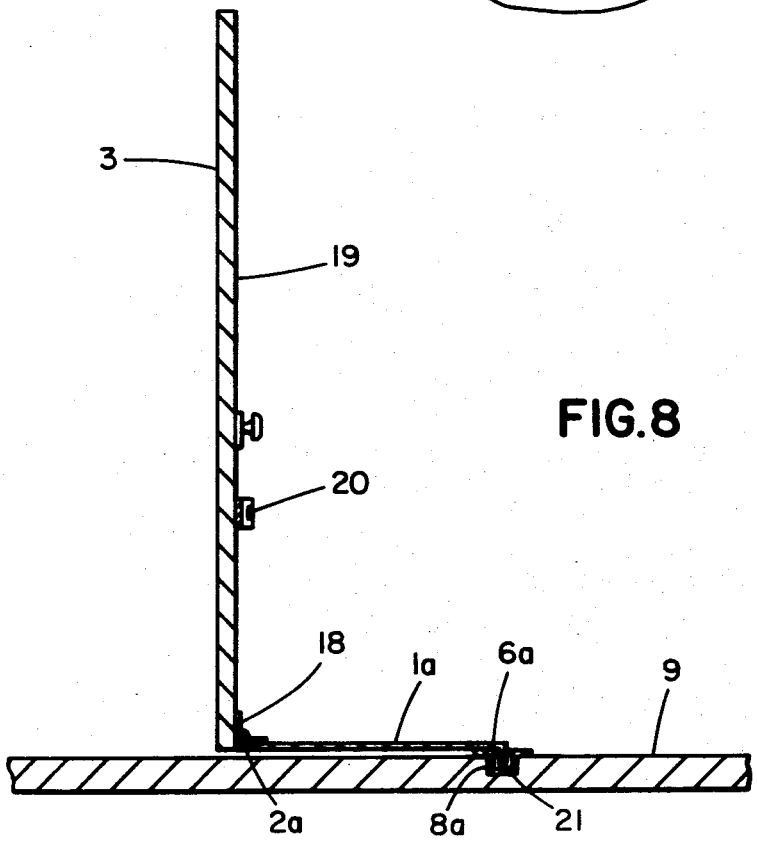
FIG. 8 is a section view showing the modification of FIG. 7 in its locked position.

A modification of the invention is shown in FIG. 7. The locking bar 1*a* in the modification is hinged at its first end 2*a* to the bottom edge 4 of the door 3 by hinge assembly 18. The locking bar 1*a* is preferably flat and lies folded against the inside wall 19 of the door 3 when in the unlocked position, and is held in such folded position by a clasp 20. In the locking position, the locking bar 1*a* is pivoted downwardly to the floor 9 when the door 3 is closed. At such time, the second end 6*a* of locking bar 1*a* is in registration with anchor socket 8*a* formed in the floor 9. The second end 6*a* of locking bar 1*a* includes a downwardly extending hook or latch 21 which seats and latches in the anchor socket 8*a* when the door 3 is closed and the second end 6*a* of locking bar 1*a* comes into registration with the anchor socket 8*a*.

In the invention shown in FIGS. 1–6, the second end 6 of the elongated locking bar 1 includes a projecting stud 22 axially centered and projecting therefrom to seat in a corresponding recess 23 opening to the abutting edge 11 of the slot 7 when the elongated locking bar 1 is placed in its locking position. The projecting stud 22 can be inserted in the recess 23 first, and the first end 2 of the elongated locking bar 1 can then be lowered in position abutting tightly against the bottom edge 4 of the door 3 to hold it locked and to prevent it from being opened. The projecting stud 22 when seated in the recess 23 prevents the second end 6 of the elongated locking bar 1 from being dislodged until an authorized person desires to remove the locking bar 1 so the door may be opened.

I claim:

1. A door lock assembly for locking a door, comprising an elongated bar having a first and a second end, said first end thereof bearing against said door when in the locking position, an anchor plate member, said anchor plate member being secured to the floor of an enclosure at a location spaced apart a pre-selected distance from said door in the direction of opening, including said floor, said pre-selected distance being far enough for said door to clear said anchor plate member when it is opened, said second end of said elongated bar has a cross-section of a first dimension, said anchor plate member including a slot formed therein opening toward said door to receive said second end of said elongated bar when placed in said locking position, said slot including spaced apart side walls being spaced apart a distance corresponding to said first dimension and being slightly larger whereby said side walls bear against corresponding portions of said elongated bar when said second end thereof is received in said slot to hold said elongated bar in the longitudinal in-line position facing said door with the first end of said elongated bar bearing against said door to prevent it from opening when said elongated bar is in said locking position, wherein said slot includes an end wall spaced apart inwardly of said anchor plate member and from said opening of said slot a pre-selected distance, said end wall extending laterally across said slot between said side walls thereof and providing an abutment surface, said preselected distance of said end wall of said slot from said opening thereof being sufficient for said side walls of said slot bearing against corresponding portions of said elongated bar when in said locking position to hold said elongated bar in said longitudinal in-line position facing said door with the first end of said elongated bar bearing against said door to prevent it from opening.

2. A door lock assembly as set forth in claim 1, wherein said second end of said elongated bar includes a projecting member projecting outwardly from said second end, said end wall of said slot includes a corresponding recess to receive said projecting member when said second end of said elongated bar is received in said slot.

* * * * *